United States Patent [19]

Kugisawa

[11] 4,184,402

[45] Jan. 22, 1980

[54] ELECTRONIC MUSICAL INSTRUMENT

[75] Inventor: Toshio Kugisawa, Hamamatsu, Japan

[73] Assignee: Kabushiki Kaisha Kawai Gakki Seisakusho, Hamamatsu, Japan

[21] Appl. No.: 863,953

[22] Filed: Dec. 23, 1977

[30] Foreign Application Priority Data

| | | | |
|---|---|---|---|
| Dec. 27, 1976 | [JP] | Japan | 51-157802 |
| Dec. 27, 1976 | [JP] | Japan | 51-157803 |
| Dec. 27, 1976 | [JP] | Japan | 51-157804 |
| Dec. 30, 1976 | [JP] | Japan | 51-158637 |
| Dec. 30, 1976 | [JP] | Japan | 51-158638 |
| Dec. 30, 1976 | [JP] | Japan | 51-158639 |

[51] Int. Cl.[2] ..... G10H 5/00

[52] U.S. Cl. ..... 84/1.26; 84/1.24; 84/1.03; 84/1.01

[58] Field of Search ..... 84/1.01, 1.03, 1.13, 84/1.24, 1.26, 1.27, DIG. 10, DIG. 11; 328/37

[56] References Cited

U.S. PATENT DOCUMENTS

| | | | |
|---|---|---|---|
| 3,809,786 | 5/1974 | Deutsch | 84/1.01 |
| 3,823,390 | 7/1974 | Tomisawa | 84/1.27 |
| 3,854,365 | 12/1974 | Tomisawa | 84/1.01 |
| 3,878,750 | 4/1975 | Kapps | 84/1.03 |
| 3,882,751 | 5/1975 | Tomisawa | 84/1.01 |
| 3,982,460 | 9/1976 | Obayashi | 84/1.01 |
| 4,014,238 | 3/1977 | Southard | 84/1.26 |
| 4,022,098 | 5/1977 | Deutsch | 84/1.03 |
| 4,077,011 | 2/1978 | Mathis | 328/37 |
| 4,079,650 | 3/1978 | Deutsch | 84/1.13 |

*Primary Examiner*—Gene Z. Rubinson
*Assistant Examiner*—William L. Feeney

[57] ABSTRACT

A digital electronic musical instrument which produces musical notes by approximately reproducing a waveshape based on information of points of extremal values on a musical waveshape, storing the approximate waveshape after sampling it with the number of the frequency at which the notes are to be produced and reading out the stored waveshape with a predetermined clock.

8 Claims, 19 Drawing Figures

ELECTRONIC MUSICAL INSTRUMENT

BACKGROUND OF THE INVENTION

1. Field of the Invention

This invention relates to an electronic musical instrument, and more particularly to an electronic musical instrument which has a musical waveshape memory part formed with a variable-stage shift register in each channel register of a non-real time processing system.

2. Description of the Prior Art

In recent digital electronic musical instrument, a key code is generated by a key switch and is assigned to a plurality of channels and the key code and the envelope corresponding thereto are applied to a musical waveshape generator. On the other hand, a tone change is detected by a tone selector from the ON-OFF state of a tone selecting tablet, draw bar switch or the like, a waveshape calculation is carried out by a waveshape calculator, the output from the waveshape calculator is applied to the musical waveshape generator to synthesize the waveshape corresponding to the key code and an envelope is added to obtain an acoustic signal output. Heretofore, two methods have been employed to provide the musical waveshape with an interval in the musical waveshape generator. A first method employs a note clock generator which generates a frequency proportional to a note frequency. Almost all of existing digital organs adopt this first method. A variety of methods have been proposed to produce a clock having the note frequency. However, the circuit of the first method is appreciably complicated and a high clock frequency, for example, 2 to 4 MHz, is required for maintaining the accuracy of frequency.

The second method sets a numerical value called "frequency number", which is proportional to frequency. The numerical value is stored in a frequency generator and accumulated by a decimal counter and an integer counter to use the frequency output as an address of a musical waveshape memory. This method poses the problem that the associate circuits become very complicated and bulky.

SUMMARY OF THE INVENTION

An object of this invention is to provide an electronic musical instrument which has a simple-structured musical waveshape memory which can be read out at a low clock frequency for adding an interval to a musical waveshape.

Another object of this invention is to provide a waveshape calculator which enables a musical waveshape to be approximately reproduced with a relatively small memory capacity.

Another object of this invention is to provide an electronic musical instrument which has a tone change detector capable of shortening the time for a waveshape calculation which is achieved by detecting a change in the ON-OFF state of tone selection switches.

Another object of this invention is to provide an electronic musical instrument which has a keyboard circuit or tone selector circuit capable of outputting ON-OFF information of a key switch or tone selection switch as a time-division multiplexed signal with a simple structure.

Another object of this invention is to provide an electronic musical instrument in which processing timing control of a keyboard circuit and the associated circuit is simplified.

Still another object of this invention is to provide an electronic musical instrument which has an envelope control circuit capable of realizing a variety of envelope waveshapes of digital processing without using a memory.

DESCRIPTION OF THE PREFERRED EMBODIMENTS

A description will be given first of the outline of an embodiment of a novel electronic musical instrument of this invention and then an embodiment of a keyboard circuit which forms the principal part of this invention.

The electronic musical instrument of this invention is a digital-processing one in which a waveshape is reproduced by approximation based on information of points of extremal values on a musical waveshape and the approximated waveshape is stored after being sampled with the number of a frequency at which a desired musical note is to be produced and is read out with a predetermined clock, thereby producing a selected musical note.

Figure 1:
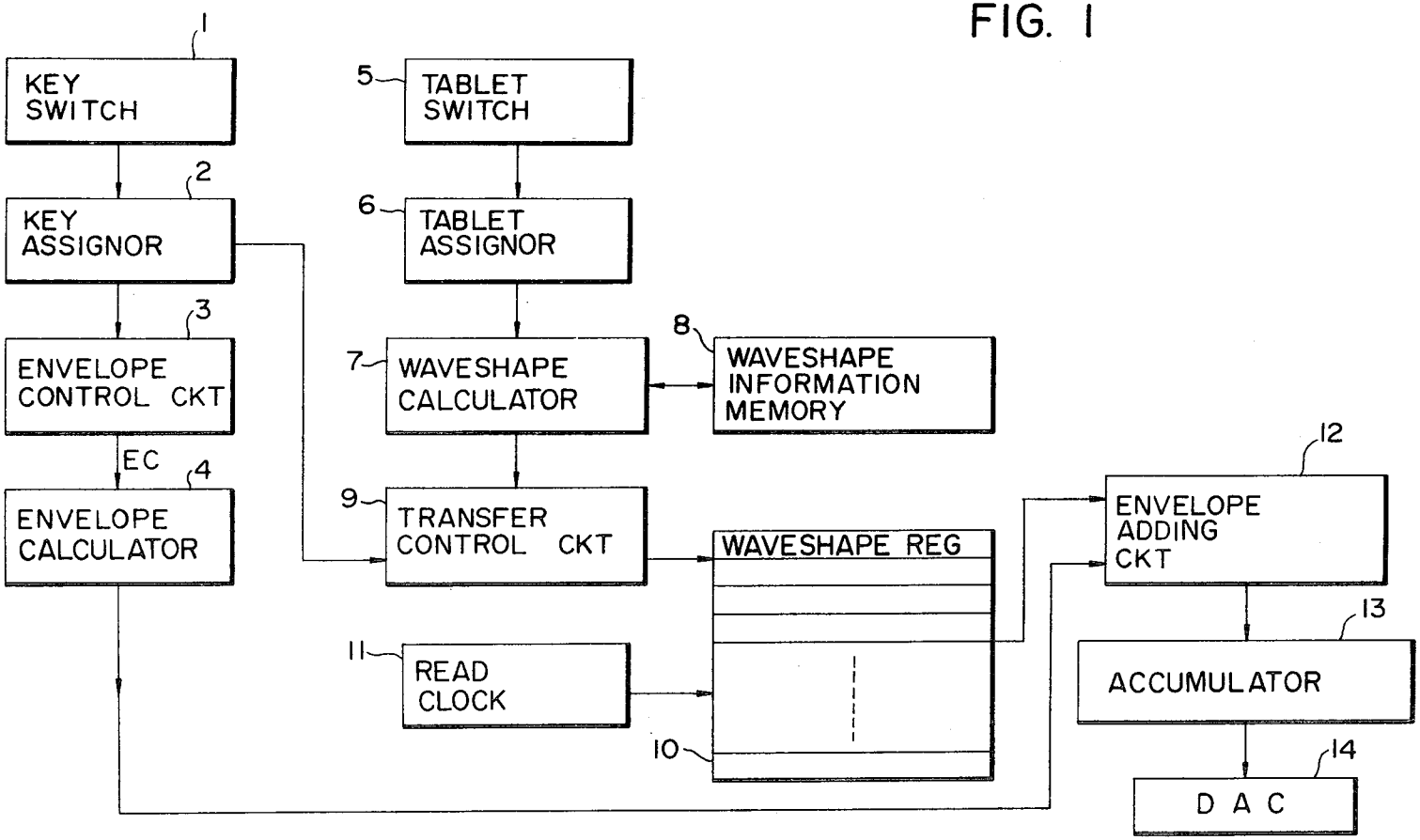
FIG. 1 is a block diagram showing the overall structure of an embodiment of this invention.

FIG. 1 is a block diagram showing the overall structure of an embodiment of the electronic musical instrument of this invention. In FIG. 1, the ON-OFF state of key switches 1 is detected by a key assignor 2 and the key code corresponding to the key switch in its on state is assigned to and planted in a priority channel in which the musical note selected by the key switch is to be produced. When a certain channel is occupied by the key assignor 2, a time-division multiplexed key-ON signal is applied to an envelope control circuit 3, in which information on the state of an envelope (attack, decay, etc.) and its magnitude is set as an envelope coefficient EC. The envelope coefficient EC is applied to an envelope calculator 4 for conversion to an envelope waveshape amplitude.

On the other hand, the ON-OFF state of tablet switches 5 is detected by a tablet assignor 6. When the ON-OFF state of the tablet switch 5 has changed, a signal for a new waveshape calculation and a signal indicating a new ON-OFF state of the tablet switch are applied to a waveshape calculator 7. The stored content of a waveshape information memory 8 corresponding to the tablet switch in its ON state is read out into the waveshape calculator 7 for calculation of one period of a complex waveshape, which is applied to a transfer control circuit 9. By the transfer control circuit 9, the complex waveshape is sampled again to the word number corresponding to the assigned note of a channel to be occupied, and is transferred to that one of the channels of a waveshape register 10 which is to be occupied. The complex waveshape read out of the waveshape register 10 with a read clock 11 is subjected to time-division multiplexing among channels and an envelope of each channel is added by an envelope adding circuit 12 and, at each period of time division among the channels, an accumulation is achieved by an accumulator 13. The output from the accumulator 13 is converted by a D-A converter (DAG) 14 to a sound signal in analog form.

Figure 2:
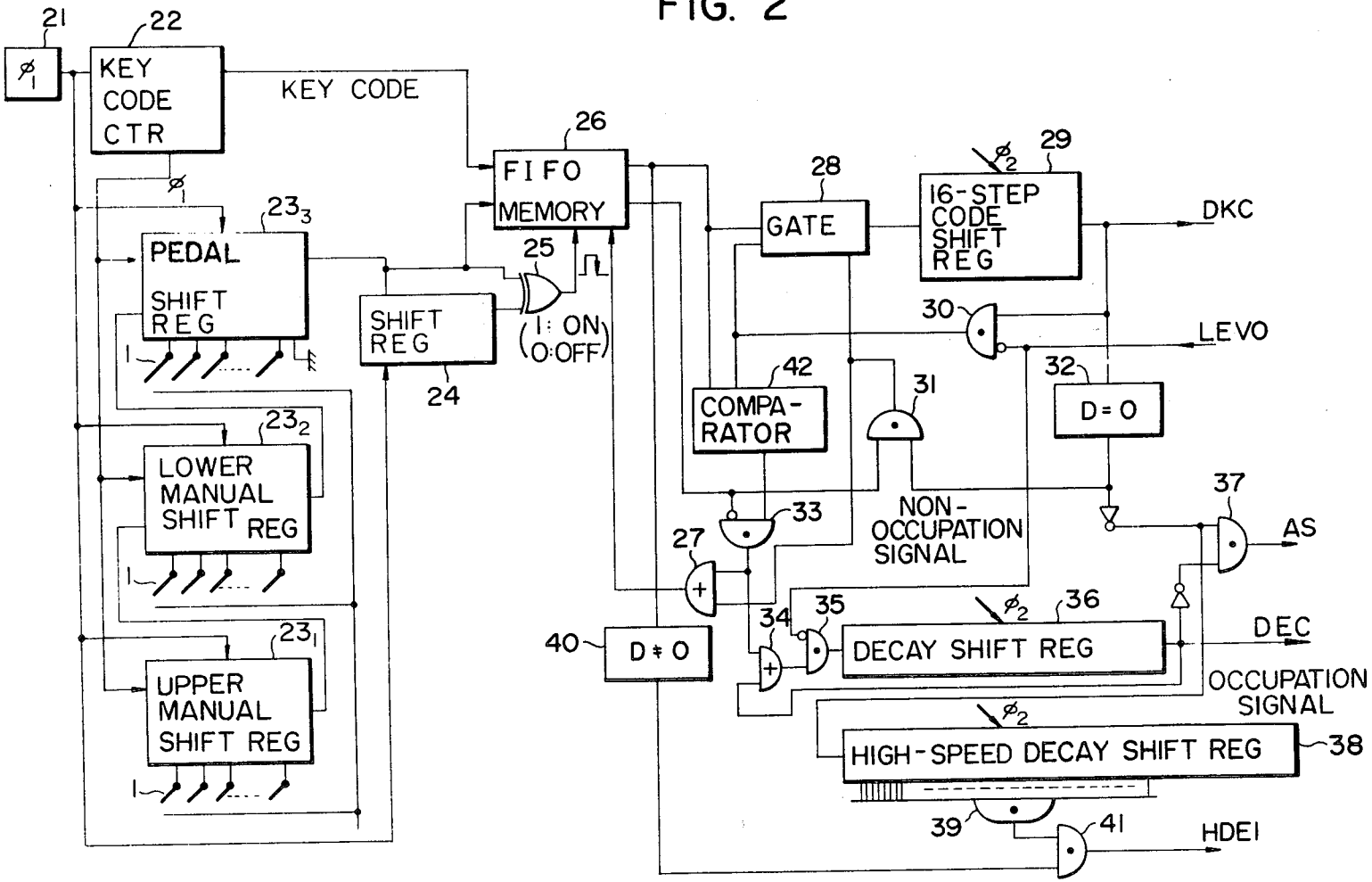
FIG. 2 is a detailed circuit diagram of a key assignor including key switches used in FIG. 1.

FIG. 2 shows in detail an example of a circuit of the key assignor 2 including the key switches 1 depicted in FIG. 1.

In an electronic organ, the keyboard comprises an upper manual, a lower manual and a pedal keyboard and has 153 keys; namely, the manual keyboards each have 61 keys and the pedal keyboard 31 keys. A key code counter 22 is actuated by a clock $\phi_1$ 21 to repetitiously generate a note code (corresponding to a note→C, C#, D, D#, . . .), an octave code and a keyboard code.

Since 12(notes)×6(octaves)×3(keyboards)=216, 216 time slots are each generated corresponding to each key switch. However, no key switches exist corresponding to 63 time slots (216−153=63). Each time slot occurs every 216 time slots and the state of all key codes being "0" with no corresponding keys is used as the first time slot. The On-OFF state of all the key switches is sampled every period and is written in an upper manual shift register $23_3$, a lower manual shift register $23_2$ and a pedal shift register $23_1$ to which the keys of the keyboards are respectively connected at one end in parallel. The three series-connected shift registers $23_1$ to $23_3$ and a delay shift register 24 are shifted with the clock $\phi_1$ and the output from each of the shift registers $23_1$ to $23_3$ and the output from the shift register 24 are compared by an exclusive OR gate 25 with each other. If the both outputs are different from each other, the output from the shift registers $23_1$, $23_2$ or $23_3$ and the key code from the key code counter 22 are written in a FIFO memory 26 serving as a timing conversion register. The difference between the both outputs means that the ON-OFF states at two successive sample points in the sampling of the ON-OFF state of the key switches are different from each other, indicating that the key switch is newly turned ON or OFF in the time interval between the two sample points. The output from the register $23_1$, $23_2$ or $23_3$ is "1" or "0" depending upon whether the key switch is turned ON or OFF. That is, based on turning ON or OFF of the key switch, a signal "1" or "0" and the key code of the key switch are written in the FIFO memory 26.

The case of reading out the ON signal will be described first. The key code and the ON signal stored in the FIFO memory 26 are read out by a read signal from an OR gate 27 and the key code is provided via a selecting gate 28 to a 16-stage code shift register 29. The number of priority channels is 16 and the code shift register 29 is composed of 16 stages and stores key codes occupying the respective priority channels. The key code of the 16-stage code shift register 29 is shifted with a clock $\phi_2$ and the code shift register 29 forms a loop with an AND gate 30 and the selecting gate 28. When supplied with a non-occupying signal from a comparator 32 and the ON signal from the FIFO memory 26, the AND gate 31 permits the selecting gate 28 to select the input thereto from the FIFO memory 26, applying the key code to the 16-stage code shift register 29. The output from the code shift register 29 is time-divided into sixteen, each of which is outputted as a time-division multiplex key code signal DKC having a time slot width of the clock $\phi_2$. By a level zero signal LEVO which is produced when the envelope is attenuated by turning OFF of the key switch to zero, the AND gate 30 is closed only for the time slot corresponding to the channel occupied by the key switch to cut off the loop, erasing the corresponding code.

In the case of reading out the OFF signal, the key code from the FIFO memory 26 is compared with the key code from the AND gate 30 and when they match with each other, a coincidence signal from a comparator 42 opens an AND gate 33 to write a signal "1" in a decay shift register 36 via an OR gate 34 and an AND gate 35. The decay shift register 36 shifts with the clock $\phi_2$ in synchronism with the 16-stage code shift register 29, and has sixteen words as is the case with the latter. The decay signal forms a loop via the OR gate 34 and the AND gate 35 and is erased by the level zero signal LEVO as is the case with the key code signal. The presence of an occupying signal which is an inverted signal of the signal from the comparator 32 and an inverted signal of the output from the decay shift register 16 indicates that the key switch occupying the channel is in the ON state. In this instance, an attack and sustain signal AS is provided from an AND gate 37.

When the key code is written by the ON or OFF signal in the 16-stage code shift register 29 or when the decay signal is written in the decay shift register 36, a read signal for reading out the next key code and ON-OFF signal is applied to the FIFO memory 26 from the OR gate 27. The occupation signal inverted from the non-occupation signal from the comparator 32 is also applied to a high-speed decay shift register 38. When all of the channels of the 16-stageshift register 29 are occupied, all time slots of the occupation signal become "1" and the outputs from the high-speed decay shift register 38 also become "1" to provide an output "1" from an AND gate 39. Under such conditions, if a new key switch is turned ON, a comparator provides an output to open a gate 41 to provide a first high-speed decay signal HDEl. In this case, however, high-speed decay does not start immediately but when a second high-speed decay signals is produced, the high-speed decay takes place.

The structure of the key assignor 2 has two features. A first one of them is the structure which easily generates the time-division multiplexed key code by sampling the shift registers respectively connected in parallel to the key switches with the clock $\phi_1$. The other is the structure which temporarily plants the time-division multiplexed key code in the FIFO memory serving as an asynchronous memory and is capable of carrying out the assignment to each channel with the clock $\phi_2$, processing of ON and OFF signals, processing in the case of all the channels being occupied, etc. independently of the clock $\phi_1$. That is, the FIFO memory is used as an asynchronous interface and the operations at the preceding stage and at the following stage can be achieved with different clocks independently of each other.

Figure 3:
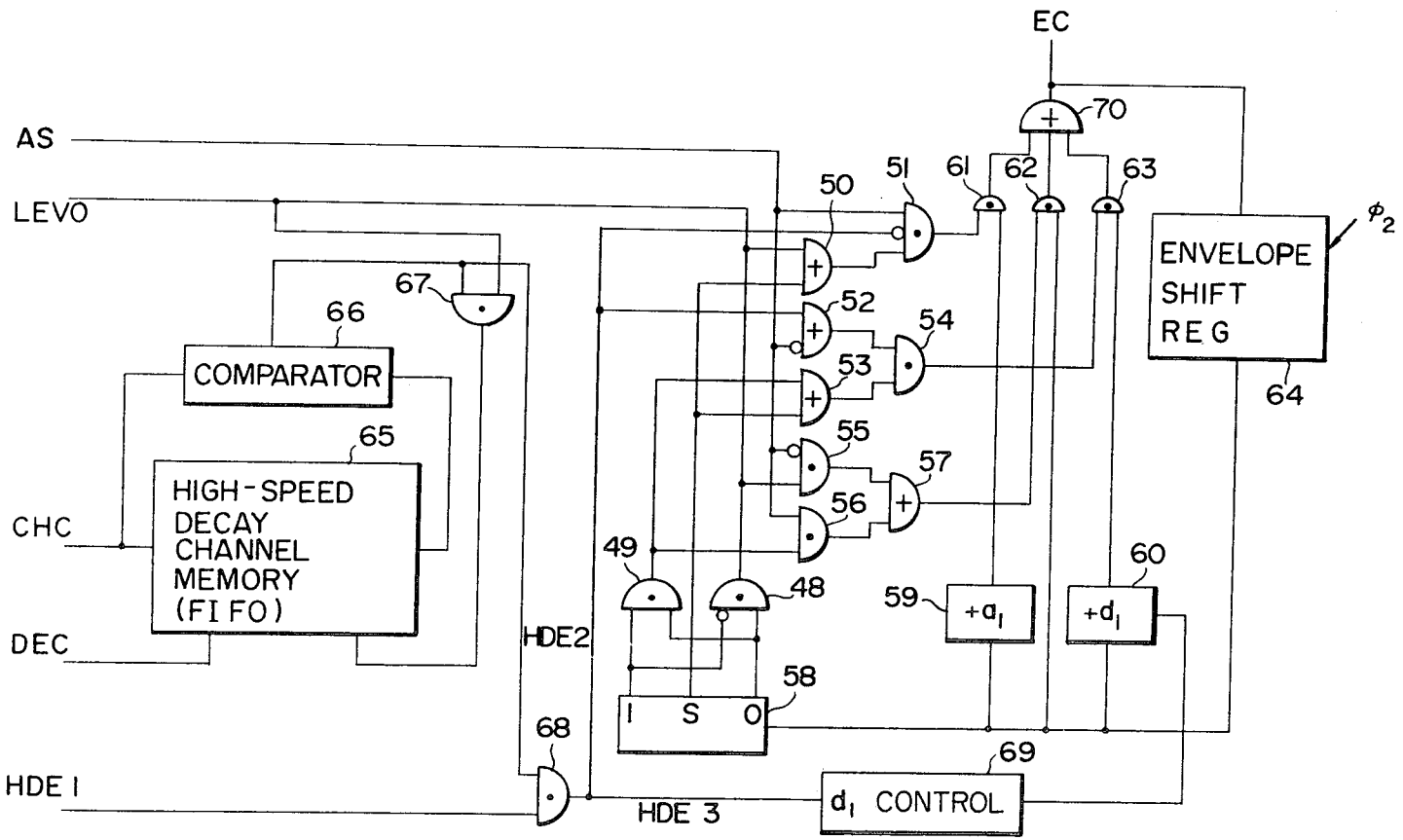
FIG. 3 is a detailed circuit diagram of an envelope control circuit utilized in FIG. 1.
Figure 4:
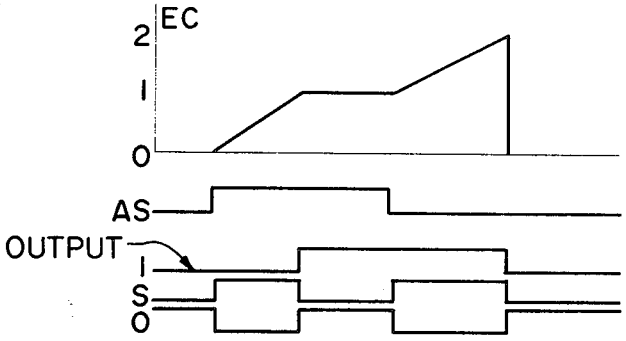
FIG. 4 shows the relationship between a signal As and an envelope coefficient EC for explaining the operation of the circuit depicted in FIG. 3.

FIG. 3 is a block diagram illustrating in detail an example of the envelope control circuit 3 utilized in FIG. 1. In FIG. 3, an envelope shift register 64 stores the envelope coefficients EC of each priority channel and is composed of sixteen stages and shifts with the clock $\phi_2$ in synchronism with the code shift register 29 and the decay shift register 36. An adder $(+a_1)$ 59 or $(+d_1)$ 60, an AND gate 61, 62 or 63 an OR gate 70 and an envelope shift register 64 form a loop, through which the envelope coefficient EC is outputted. When the priority channel is occupied upon turning ON of the key switch, the attack-sustain signal AS is provided from the AND gate 37 in FIG. 2. This signal continues until the key switch is turned OFF. The envelope coefficient EC varies within the range of $0 \leqq EC < 2$, and is applied from the envelope shift register 64 to a comparator 58 to provide therefrom a combination of three kinds of signals in response to the variation. FIG. 4 shows the relationship between the signal AS and the envelope coefficient EC. In FIG. 4, the relation of time division among the channels is omitted for the sake of simplicity. That is, the comparator 58 is constructed so that signals 1, S and 0 become "1" when $1 \leqq EC < 2$, when $0 < EC < 1$ and $1 < EC < 2$ and when $EC = 0$ and $EC = 1$, respectively. The signal 0 and an inverted signal of the signal "1" are applied to an AND gate 48 to derive therefrom a level 0 signal, i.e. LEVO, while the signals "1" and "0" are applied to an AND gate 49 to provide a sustain state of level "1".

The envelope coefficient EC is zero at first, and is applied via an OR gate 50 to an AND gate 51 together with the signal AS to provide a loop passing through the AND gate 61. Then, the adder $(+a_1)$ 59 adds an attack increment $a_1$ to the input from the envelope shift register 64. That is, the increment $a_1$ is added for each loop but $0 < a_1 << 1$. As the loop is repetitiously formed, the envelope coefficient EC approaches "1". When the envelope coefficient EC has reached "1", the AND gate 51 closes and an AND gate 56 and an OR gate 57 open to set up a loop passing through the AND gate 62. This loop does not include any adder and is repetitiously formed, with the envelope coefficient EC held at the value "1". Upon turning OFF the key switch, the signal AS becomes 0 and an AND gate 54 is opened via an OR gate 52 and the AND gate 56 is closed, setting up a loop passing through the AND gate 63. This loop includes the adder $(+d_1)$ 60, by which an increment $d_1$ is added for each loop. In this case, $0 < d_1 << 1$. As the loop is repetitiouly formed, the envelope coefficient EC approaches "2" from "1" and when it reaches "2", it immediately becomes 0. Since the signal AS becomes "0", the AND gate 55 and the gate OR 57 open to repetitiously maintain $EC = 0$.

Next, the high-speed decay will be described. A channel code CHC is written by a decay signal DEC from the decay shift register 36 of FIG. 2 in a high-speed decay memory 65 formed with a FIFO memory. The output from the high-speed decay memory 65 is compared with the channel code CHC in a comparator 66 and when they match with each other, the comparator 66 provides a coincidence signal. That is, a coincidence signal HDE1 is produced in the time slot of the channel which starts decay earlier than the other channels. When the envelope coefficient EC of this channel becomes zero with the signal LEVO, read of the high-speed decay channel memory 65 is advanced by one step via an AND gate 67 and a coincidence signal is provided in the time slot of the channel starting decay next. This coincidence signal is the second high-speed decay signal HDE2. When the first and second high-speed decay signals HDE1 and HDE2 simultaneously occur, an AND gate 68 opens to provide a third high-speed decay signal HDE3, actuating a $d_1$ control circuit 69. With the third high-speed decay signal HDE3, the $d_1$ control circuit 69 changes the increment $d_1$ to $d_2$ $(d_1 < d_2)$. Further, the third high-speed decay signal HDE3 retains decay via the AND gate 51 and the OR gate 52. Thus, the decay speed is increased to rapidly complete decay and provide an empty address in the channel of the code shift register 29 in preparation for the assignment thereto of the key code of a key switch newly turned ON.

FIGS. 5A and 5B, FIGS. 6A and 6B, FIGS. 7A and 7B and FIGS. 8A and 8B are respectively explanatory of different examples of the envelope calculator 4 utilized in FIG. 1.

Figure 5A:
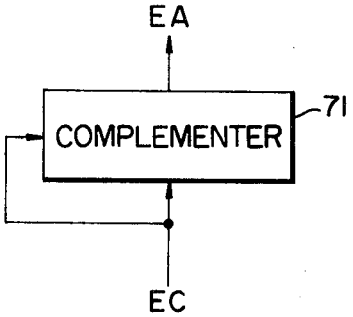
FIGS. 5A and 5B, FIGS. 6A and 6B, FIGS. 7A and 7B and FIGS. 8A and 8B are respectively explanatory of different examples of an envelope calculator used in FIG. 1.
Figure 5B:
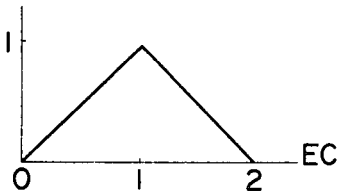

The envelope calculator of FIG. 5A is formed with a complementer 71 from which the envelope coefficient EC is outputted as such an envelope amplitude value signal EA as shown in FIG. 5B which is not complemented in the period in which the coefficient EC is "0" to "1" but which is inverted with its decimal part S complemented with a signal of its integer part 1 in the period in which the coefficient EC is "1" to "2". Accordingly, such a sawtooth waveshape as depicted in FIG. 5B is obtained.

Figure 6A:
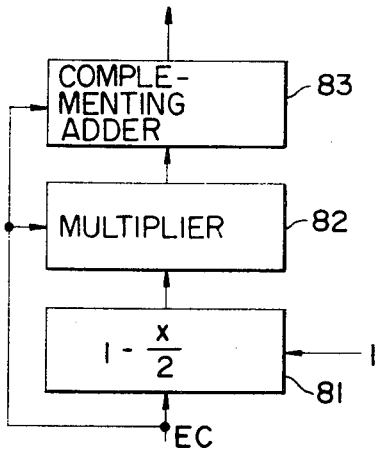
Figure 6B:
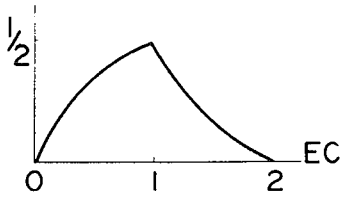

FIG. 6A illustrates another example of the envelope calculator, in which the envelope waveshape is approximated to a logarithmic curve. That is, as an approximate equation of $\log x \approx x - x^2/2 + x^3/3 - x^4/4 + \ldots$ (where $0 < x < 1$), $\log x \approx x(1 - x/2)$ using the terms of the right side up to the second one. Letting the value of the envelope coefficient EC be represented by x, a calculator 81 composed of a subtractor and a scaler is supplied with "1" and x to calculate $(1 - x/2)$ and a multiplier 82 is supplied with x to provide $x(1 - x/2)$. In the period in which x is "0" to "1", an attack waveshape approximate to a logarithmic curve is calculated and outputted from the multiplier 82 and, in the period of x being "1" to "2", the value from the multiplier 82 is complemented by the signal "1" of the integer part of the coefficient EC to add "$\frac{1}{2}$" in a calculator composed of a complementer and an adder, by which an envelope waveshape of attack approximate to a logarithmic attenuation curve shown in FIG. 6B can be calculated. Since the maximum amplitude is "$\frac{1}{2}$", if the output is shifted to be doubled, the maximum amplitude can be made "1" as is the case with the abovesaid example. The scaler mentioned above is a shift circuit which easily makes the value of a binary number twice, four times, eight times, $\ldots 2^n$ times, $\frac{1}{4}$ times, $\frac{1}{8}$ times, $\ldots \frac{1}{2}^n$ times by shifting to right or left.

Figure 7A:
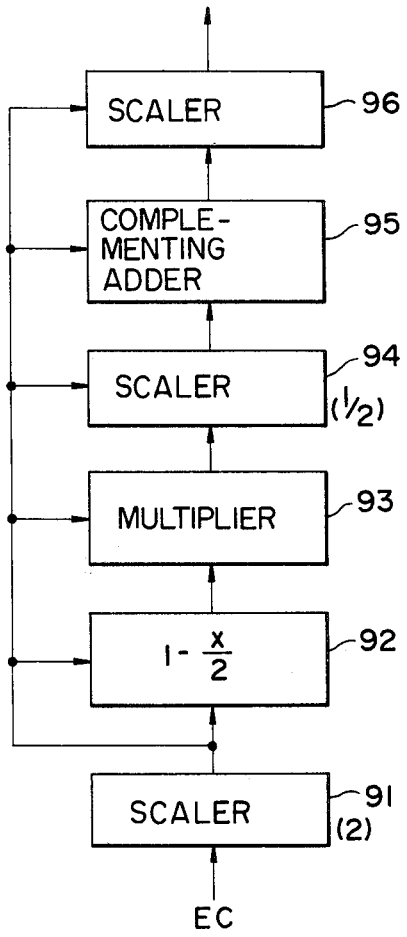
Figure 7B:
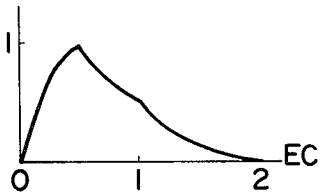

FIG. 7A shows another xample of the envelope calculator, which is an application of the envelope calculator shown in FIG. 6. That is, in the period in which x is "0" to "$\frac{1}{2}$", a calculator 91 formed with a scaler produces 2x and a calculator 92 calculates $(1 - x/2)$, which is multiplied by 2x in a multiplier 93, and then it is doubled by a scaler 96. While x is "½" to "1", the scaler 91 provides 2x to actuate the calculator 92 and the multiplier 93 and, in a calculator 95, it is complemented to be added with "1". In the period in which x is "1" to "2", the calculator 92 and the multiplier 93 are operated and, further, the calculator 95 and the sealer 96 are actuated. In this manner, there is obtained an envelope waveshape including a stepped decay waveshape such as depicted in FIG. 7B.

Figure 8A:
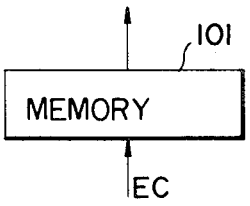
Figure 8B:
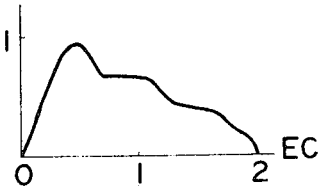

FIGS. 8A and 8B illustrate another example of the envelope calculator. This is method of reading out a memory using the envelope coefficient EC as an address code of a memory 101. In this instance, a desired envelope waveshape can be obtained.

The foregoing embodiment has been described mainly in connection with the operation of one channel but, as described above with the key assignor 2, the processing for assignment of a key switch turned ON to a plurality of channels is performed on a time shared basis, and the waveshape corresponding to the key code and the aforesaid envelope waveshape are produced with the clock $\phi_2$ on a time shared basis and synthesized by an envelope adder into a musical waveshape.

As described above, an asynchronous interface composed of a memory is provided between a key code extracting part and a key code control part of the former and the latter stage of a keyboard circuit, respectively, and a key code time divided at the processing timing of the former stage is temporarily stored in the asynchronous interface and is read out therefrom at the processing timing of the latter stage for channel assignment, data processing, etc., so that the processing of the latter stage can be freely set regardless of the processing timing of the former stage and a structure for timing control can be simplified. Further, the electronic musical instrument of this invention is provided with an envelope control circuit in which an envelope coefficient indicating the state of an envelope is stored in respective stages of a shift register, a circulating loop is formed with the shift register and an adder or subtractor, the envelope coefficient outputted from the shift register is applied to a comparator and the output from the adder or subtractor is controlled by the output level signal of the comparator or an external signal, whereby the envelope coefficient is changed to set the envelope coefficient of each channel on a time shared bases, and in which the envelope coefficient is applied to an envelope calculator to enable realization of various kinds of envelope waveshapes. Thus, the envelope waveshape can be produced on a time shared basis by applying the envelope coefficient to the envelope calculator, so that no memory is needed, permitting of simplification of the structure.

Figure 9:
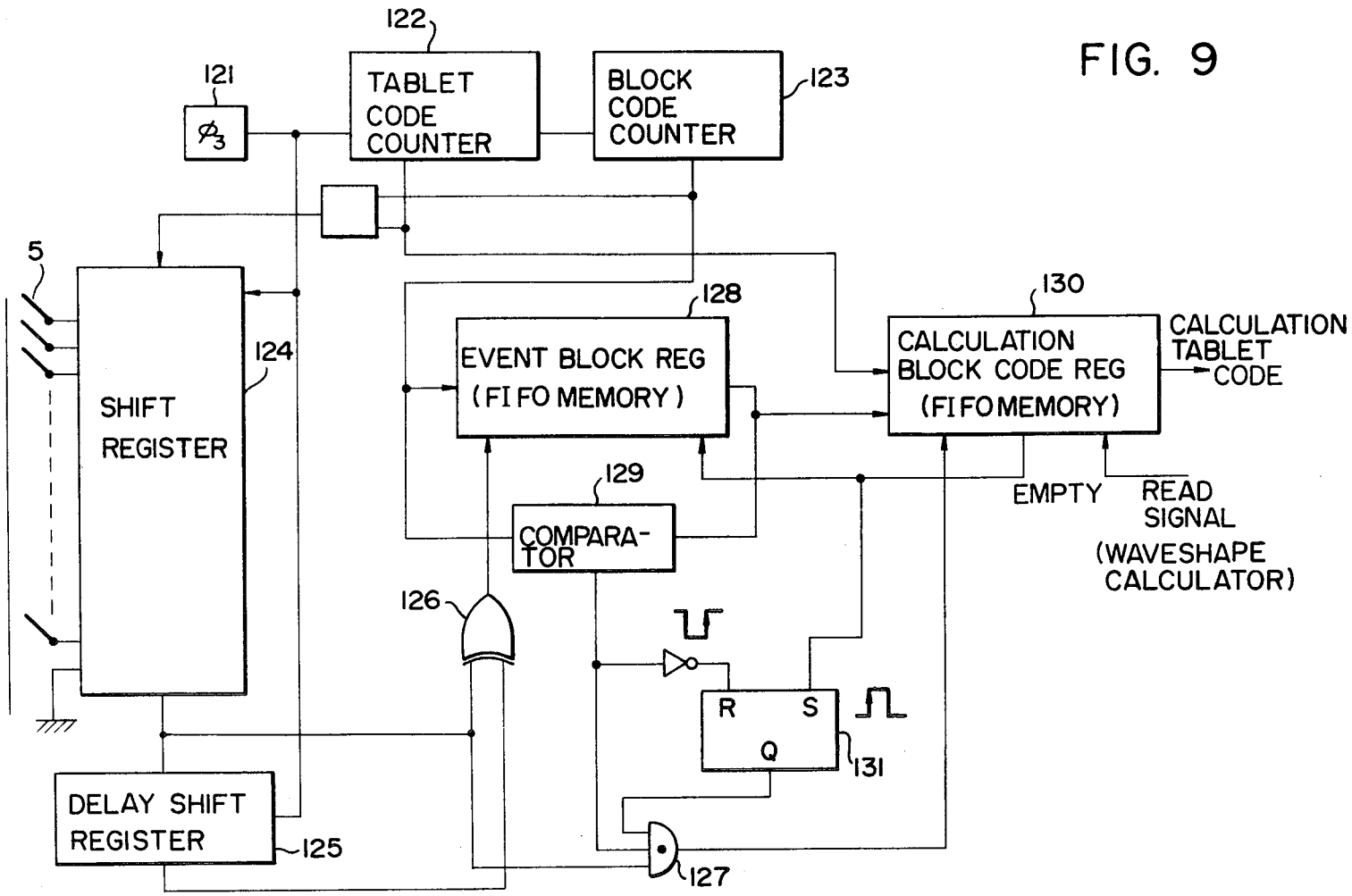
FIG. 9 is a detailed circuit diagram of an example of a tablet assignor including tablet switches utilized in FIG. 1.

FIG. 9 shows in detail an example of the tablet assignor 6 including the tablet switch 5 in FIG. 1. In FIG. 9, in accordance with their ON-OFF state, the tablet switches are counted by a tablet code counter 122 with a clock $\phi_3$ from a clock generator 121 and are further counted in terms of block codes of a plurality of blocks into which the tablet switches are divided. In this instance, the blocks can also be divided according to the upper manual, lower manual and pedal or further subdivided. The block code is a code for identifying each block. The tablet code counter 122 and the block code counter 123 repetitiously perform counting and, every period of the counting, the ON-OFF states of the tablet switches 5 are sampled and simultaneously written in a shift register 124 to which the tablet switches 5 are connected at one end in parallel. The shift register 124 and a delay shift register 125 connected in series thereto are shifted with the clock $\phi_3$ and the outputs from the both shift registers are compared by an exclusive OR gate 126 with each other. The difference between the signals at two successive sample points in the sampling of the ON-OFF state means turning ON or OFF of a tablet switch between the two sample points. Then, by the output from the exclusive OR gate 126 indicating the difference between the output signals from the shift registers 124 and 125, the block code of the block to which the tablet switch turned ON or OFF belongs is written in an event block register 128 from the block code counter 123. The event block register 128 is formed with a FIFO memory serving as an asynchronous buffer memory. Where the tablet switches of two or more blocks are turned ON or OFF, the blocks are sequentially processed in the order of turning ON or OFF of the tablet switches.

The output from the event block register 128 is compared with the block code in a comparator 129 to provide a coincidence signal in the time slot of the block code equal to the output from the event block register 128. The coincidence signal is inverted and applied to a reset terminal (R) of a flip-flop 131 to set it with an empty signal of a calculation block code register 130 described later and the flip-flop 131 is reset with the trailing edge of the next coincidence signal from the comparator 129. In the time slot provided by setting and resetting of the flip-flop 131, the tablet codes of those of the tablet switches in the block which are turned ON are all written by the tablet signals from the shift register 124 in the calculation block code register 130 via an AND gate 127. The table codes thus written in the register 130 are sequentially read out therefrom the read signals from the waveshape calculator 7 in FIG. 1. Since the calculation block code register 130 is formed with a FIFO functioning as an asynchronous buffer memory, the read signals need not be synchronized with the clock $\phi_3$. When the output codes of the calculation block code register 130 have all been read out therefrom, the next block code is read out of the event block register 128 by the empty signal from the register 130. That is, after completion of the waveshape calculation of each block in the waveshape calculator in FIG. 1, the block code is read out.

As described above, in this invention, tablet switches, i.e. tone selecting switches, are divided into a plurality of blocks and only the block in which the tablet switch is turned ON is detected, and only the tone code of the ON state of the detected block is extracted and a waveshape calculation is carried out, by which the calculation time can be remarkedly shortened, as compared with that in the conventional method of achieving a waveshape calculation scanning all tone selecting switches.

Also, in the above example, if the shift register having connected in parallel thereto the tablet switches is sampled with the clock $\phi_3$, time-division multiplexed tablet codes can be generated easily as compared with the conventional TDM method or the like.

Further, where tablet codes, time-division multiplexed with the clock $\phi_3$, are temporarily planted in a FIFO memory, the degree of freedom of design is increased since processing at the latter stage needed not be synchronized with the clock $\phi_3$ of the former stage.

Figure 10:
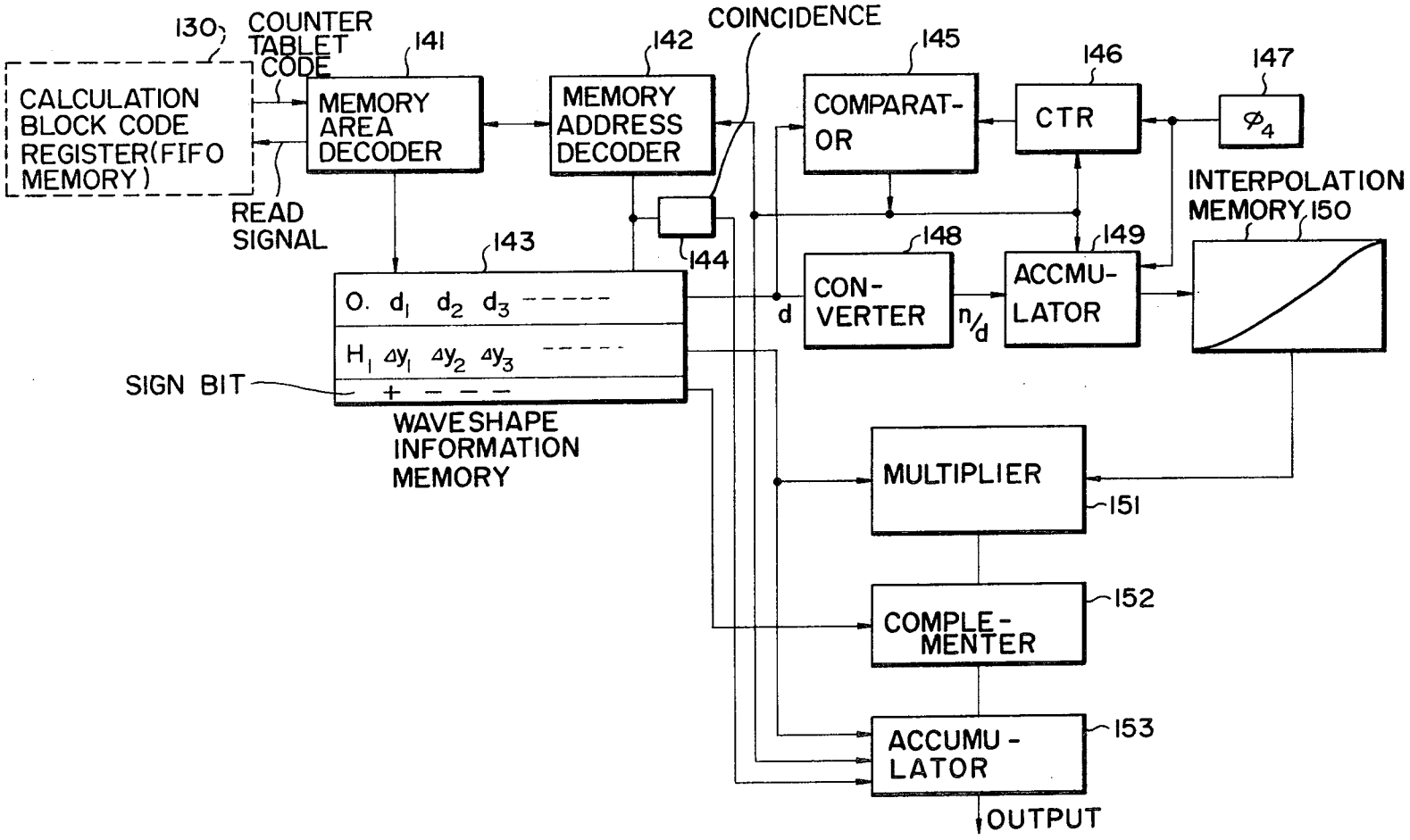
FIG. 10 is a detailed circuit diagram of a waveshape information calculator including a waveshape information memory used in FIG. 1.

FIG. 10 illustrates in detail an example of the waveshape calculator 7 including the waveshape information memory 8 in FIG. 1.

The waveshape calculation method of this invention, which utilizes the points of extremal values of an original musical waveshape, that is, the points where differential coefficients are reduced to zero, is to store the distance of each point of extremal value from a reference point on the time axis and the absolute position of the amplitude at the point of extremal value in one period of the musical waveshape, or to store the distance between adjacent ones of the points of extremal values on the time axis and the relative positions of them in the direction of amplitude and to interpolate between the points of extremal values while sequentially reading out the information of the respective points, thereby approximately reproducing the original waveshape.

A memory area address decoder 141 applies a period signal to the calculation block code register 130 in FIG. 9 at each calculation of one period to read out therefrom the calculation tablet codes of one period into the memory areas of the decoder 141, which codes are applied to a memory address decoder 142.

The waveshape information memory 143 has planted therein an initial value 0 and values $d_1$, $d_2$, $d_3$, . . . of the aforesaid distance between adjacent ones of the points of extremal values on the time axis and an initial value 0 and values $\Delta y_1$, $\Delta y_2$, $\Delta y_3$, . . . of the distances in the amplitude direction. When the memory address decoder 142 provides an address 0, the initial amplitude value $H_1$ stored in the waveshape information memory 143 at its address 0 is writeen in an accumulator 153 with a coincidence signal from a coincidence circuit 144. At this time, since the count value of a counter 146 is also zero, a comparator 145 provides a reset pulse to advance the memory address decoder 142 to the next address 1. As a result of this, the information $d_1$ and $\Delta y_1$ of the address 1 are read out of the waveshape information memory 143 and the information $d_1$ is converted by a converter 148 to n/d, where n is the word number of an interpolation memory 150 described later on. The output n/d from the converter 148 is applied to an accumulator 149 for accumulation, from which are sequentially derived n/d, 2n/d, 3n/d, . . . . The interpolation memory 150 is read out at time intervals of n/d and the output therefrom is multiplied by $\Delta y_i$ in a multiplier 151. By a sign bit signal discriminating whether the waveshape decreases from its maximum to minimum value or increases from the minimum to the maximum value, the multiplied output is complemented in a complementer 152 only in the former case. The output from the complementer 152 is added to the initial value $H_1$ in the accumulator 153. The initial value $H_1$ is constant but the output from the complementer 152 varies as the counting of the counter 146 proceeds, so that the added output from the accumulator 153 also varies correspondingly. When the counter 146 has achieved a $d_1$th count, the counter 146 and the accumulator 149 are reset with a coincidence signal from a comparator 145 and the value $\Delta y_1+H_1$ that $\Delta y_1$ multiplied by $\Delta y_1$ is added to the final value 1 of the interpolation memory 150 is stored as the next initial value in the accumulator and the memory address decoder reads out the next address. By the repetition of the abovesaid operations, one period of the waveshape is calculated and outputted. Each time one period of the waveshape is calculated, a period signal is applied to the memory area decoder 141 and, for the next waveshape calculation, the memory area decoder 141 reads out the calculation block code register 130 of the tablet assignor in FIG. 9 to assign the next memory area. In this manner, the musical waveshape can be reproduced approximately.

As explained above, the positional information of each point of extremal value of a musical waveshape is stored in a waveshape information memory and the interpolation curve connecting adjecent ones of the points of extremal values is stored in an interpolation memory and then the information of the extremal values are read out and interconnected by the aforesaid interpolation curves, whereby the musical waveshape can be reproduced approximately. Thus, a satisfactory approximate waveshape can be reproduced with a far smaller memory capacity than in the case of using a stairstep-like quantized waveshape in the prior art.

Figure 11:
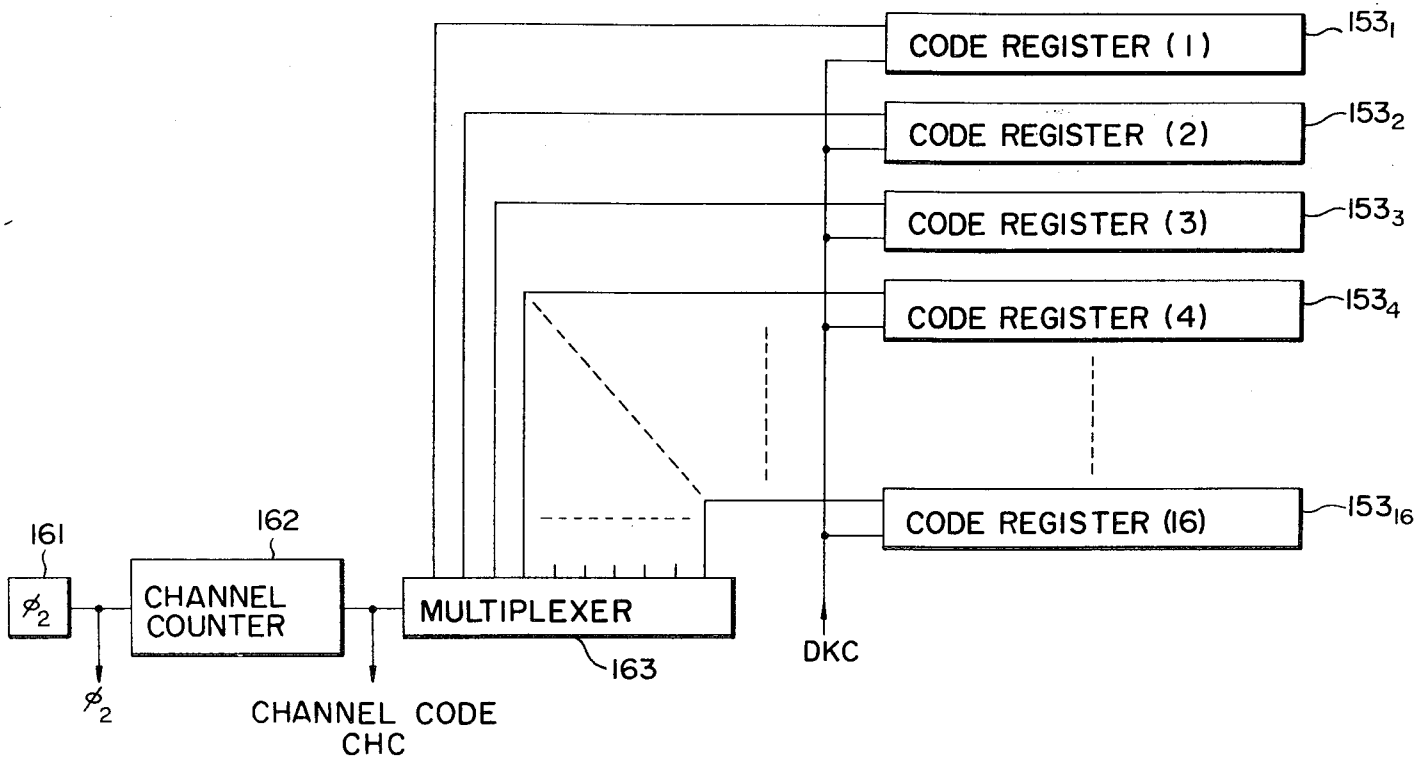
FIG. 11 is explanatory of a time-division supply system for supplying a time-dividing key code from a 16-stage code shift register to a waveshape register in FIG. 2.

FIG. 11 shows a system of a time sharing supply of a time-divided key code DKC from the 16-stage code shift register 29 in FIG. 2 to the waveshape register 10 (see FIG. 1). With the clock $\phi_2$, a channel counter 162 carries out a 16-step counting and the channel code CHC derived from the counter 162 is applied to a multiplexer 163. The multiplexer 163 applies write pulses to code registers $153_1$ to $153_{16}$ of the waveshape register 10 one after another. The code registers $153_1$ to $153_{16}$ write in their time slots those key codes of the time-divided key code signals which correspond to their channels, respectively.

Figure 12:
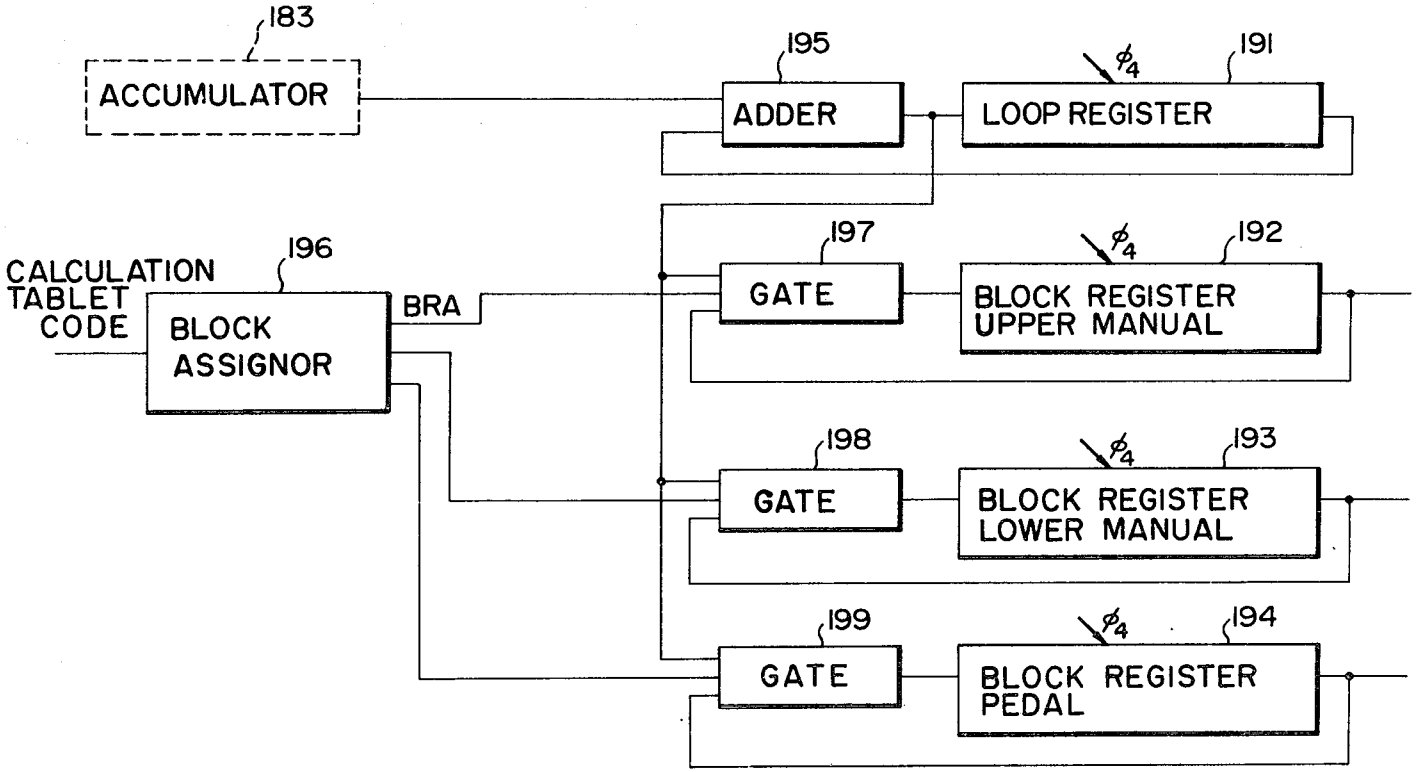
FIGS. 12 and 13 are detailed explanatory diagrams of the waveshape register including a transfer control circuit and a read clock generator in FIG. 1.
Figure 13:
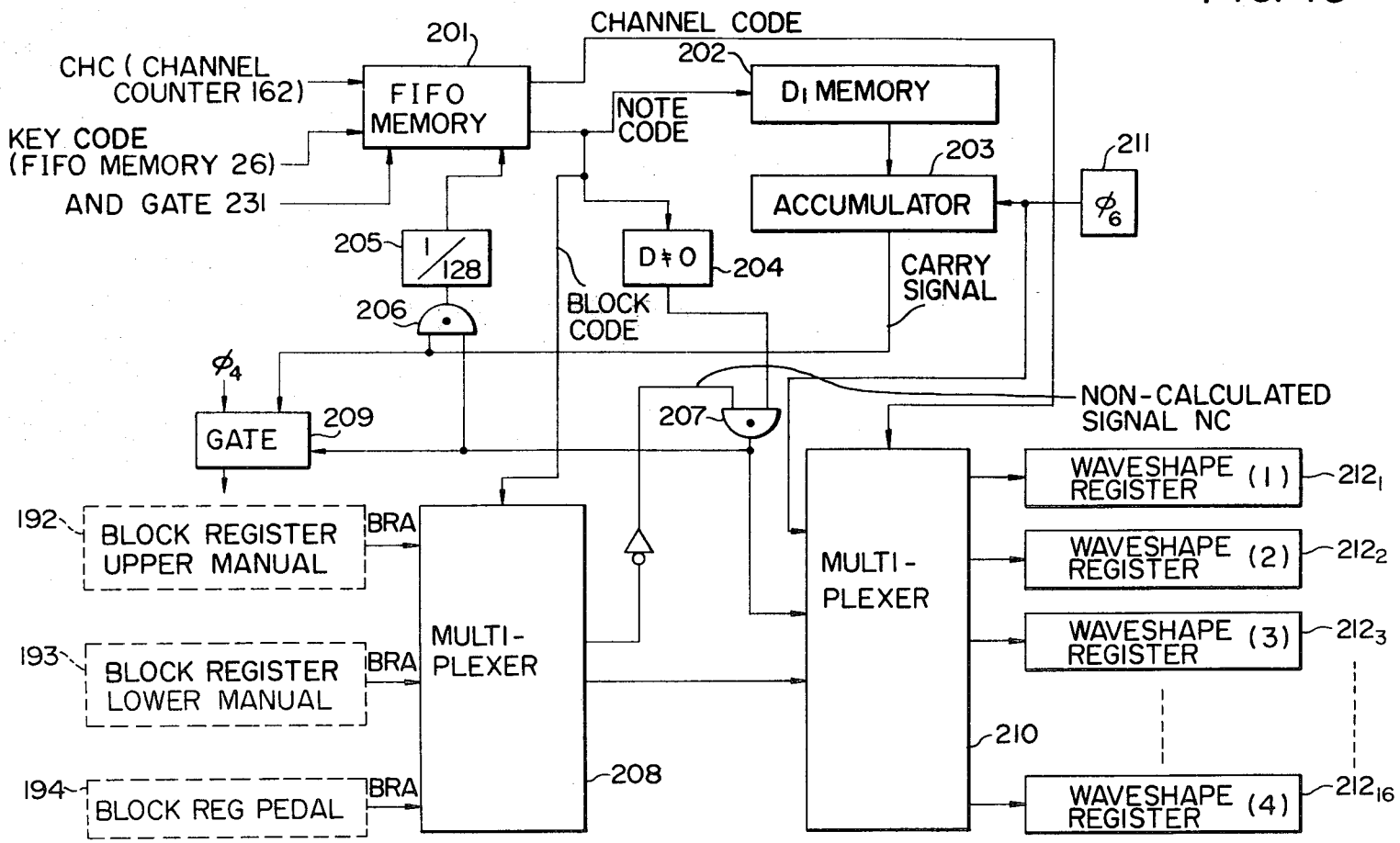

FIGS. 12 and 13 respectively show in detail the waveshape register 10 including the transfer control circuit 9 and the read clock generator 11 in FIG. 1.

In FIG. 12, waveshapes of each tone calculated by an accumulator 183 of the waveshape calculator 7 (FIG. 1) are superimposed added by an adder 195 and a loop shift register 191 every period, obtaining a complex waveshape. A block assignor 196 opens one of gates 197 to 199 with a block register assignment signal BRA to write the complex waveshape from the adder 195 in the corresponding one of block registers 192 to 194. The block registers 192 to 194 are shift registers of 128 words respectively corresponding to the upper manual, lower manual and pedal, which registers shift with a clock $\phi_4$.

In FIG. 13, the outputs from the block registers 192 to 194 in FIG. 12 are transferred to variable-length waveshape registers $212_1$ to $212_{10}$ via multiplexers 208 and 210.

In FIG. 13, the channel code CHC from the channel counter 162 in FIG. 11 and the key code from the FIFO memory 26 of the key assignor of FIG. 2 are written in a FIFO memory 201 with the output from an AND gate 231. Of the output key codes from the FIFO memory 201, the note code is applied to a $D_1$ memory 202 and the block code to the multiplexer 208. The $D_1$ memory 202 has stored therein twelve numerical values for each note, such, for example, as shown in the following Table 1:

Table 1

| Note | C | C# | D | D# | E | F |
|---|---|---|---|---|---|---|
| Numerical value $D_1$ | 128/239 | 128/253 | 128/268 | 128/284 | 128/301 | 128/319 |
| Note | F# | G | G# | A | A# | B |
| Numerical value $D_1$ | 128/338 | 128/358 | 128/379 | 128/402 | 128/426 | 128/451 |

The numerical value 128 is the word number of the block registers 192 to 194 and 239, 253, . . . 451 are numerical values proportional to the note frequency. The numerical values need not be limited specifically to the above so long as they are proportional to the note frequency. But they are set in the range of $0<D_1<1$.

The value $D_1$ from the $D_1$ memory 202 is accumulated in an accumulator 203 at the speed of a clock $\phi_6$ 211 and a carry signal opens a gate 209 to apply the shift signal $\phi_4$ to the block registers 192 to 194. For instance, in the case of the note being A, which 128 shift signals $\phi_4$ are produced, 402 clocks $\phi_6$ are provided and the block registers 192 to 194 make a round. The carry signal is applied via a gate 206 to a frequency divider 205 to provide therefrom one read pulse every 128 shift signals $\phi_4$, reading out the next block code from the FIFO memory 201. The channel code from the FIFO memory 201 is applied to the multiplexer 210. Where no note code exists in the FIFO memory 201, the output from a comparator ($D\neq0$) 204 and a non-calculated signal NC from the multiplexer 208 are provided via an AND gate 207 to the multiplexer 210 to start sampling transfer. The signal NC is a signal that the signal BRA from the block registers 192 to 194 is inverted by the multiplexer 208. Only when no waveshapes are written in the block registers 192 to 194, the gate 199 (FIG. 12) and the block assignor 196 (FIG. 12) open and sampling transfer is provided via the multiplexers 208 and 210 to one of the waveshape registers $212_1$ to $212_{16}$ from the block registers 192 to 194. The multiplexer 210 selects the waveshape registers $212_1$ to $212_{16}$ with the channel code from the FIFO memory 210 to enable read with the certain clock $\phi_6$ for any note frequency.

Figure 14:
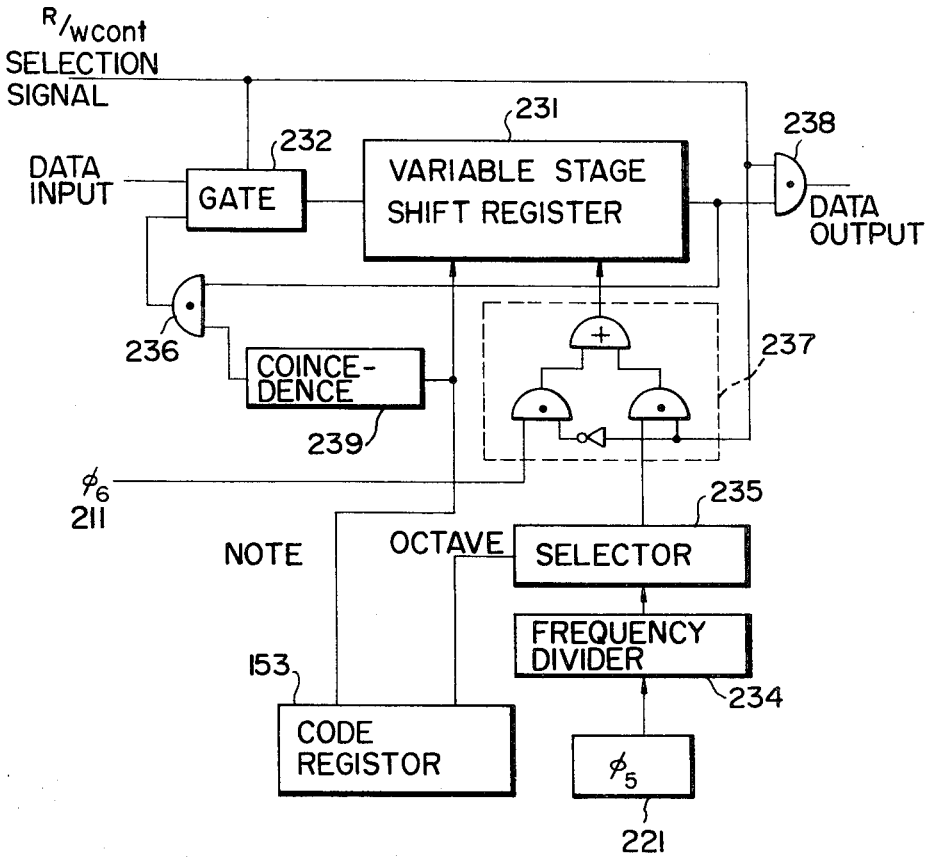
FIG. 14 is a detailed explanatory diagram of a waveshape register used in FIG. 13.
Figure 15:
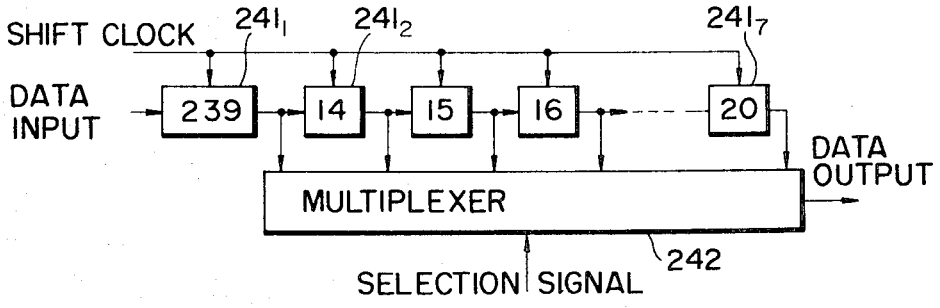
FIG. 15 shows an example of a variable-stage shift register in FIG. 14.

FIG. 14 illustrates in detail an example of the waveshape register 212 in FIG. 13. In FIG. 14, the key code stored in the code register 153 described above in connection with FIG. 11 is applied to a selector 235 to select one of clocks that a read clock $\phi_5$ 221 is frequency divided by a frequency divider 234. The note code stored in the code register 153 is applied to a variable stage shift register 231. The variable-stage shift 231 is a shift register that the number of its stages is controllable from the outside. FIG. 15 shows an example of this shift register. That is, a 239-step counter $141_1$ is used as the basic counter corresponding to the numerical value shown in Table 1 and 14-, 15-, 16- . . . step counters are connected in series and taps of the connection points are connected in parallel to a multiplexer 242. By controlling the multiplexer 242 with a selection signal, a shift register of a desired number of stages is provided, which derives at its output end the shift data output.

Turning back to FIG. 14, in the case of a selection signal R/Wcont being "0", a gate 232 selects a waveshape signal, which is written in the variable-stage shift register 231. A selector 237 selects the clock $\phi_6$ to write the waveshape signal in the variable-stage shift register 231 while shifting it with the clock $\phi_6$. In this while, a gate 238 is closed. When the selection signal R/Wcont is "1", the gate 232 selects the waveshape signal from a gate 236 and the gate 238 is closed. The selector 237 selects the clock from the selector 235 to shift the variable-stage shift register 231. Only where the code register 153 has stored therein the key code, that is, where the channel is occupied, the gate 236 is opened by a coincidence circuit 239 to open the loop.

As set forth above, according to this invention, the waveshape shift registers for storing musical waveshapes on a time shared basis corresponding to a plurality of channels are each formed with a variable-stage shift register whose stage number is set in proportion to the note frequency and which stores one period of the waveshape. The shift register can be read out with a constant clock, as described above, and the structure can be remarkedly simplified as compared with conventional methods because it is sufficient to prepare the same numbers of variable-stage registers and control circuits as the number of channels.

It will be apparent that many modifications and variations may be effected without departing from the scope of the novel concepts of this invention.

What is claimed is:

1. An electronic musical instrument having waveshape memory parts for storing musical waveshapes on a time shared basis corresponding to a plurality of channels of key codes provided by turning ON and OFF of key switches, characterized in that the waveshape memory part of each channel is a variable-stage shift register having its number of stages set in porportion to a note frequency and storing one period of the waveshape and in that a read clock for the waveshape memory part is constant regardless of the note frequency.

2. An electronic musical instrument according to claim 1, wherein there is provided a tone change detector composed of means for detecting key information and storing it and means for checking the stored information for detecting that one of a plurality of blocks of tone selection switches whose tone selection switch has changed its ON-OFF state and means for extracting only a note code of the ON state in the block to which the switch having changed its state belongs.

3. An electronic musical instrument according to claim 1, wherein there is provided a waveshape calculator composed of a waveshape information memory for storing information of each extremal value of the musical waveshape and its position on the time axis, an interpolation memory for storing an interpolation curve interpolating adjacent ones of the extremal values and means for reading out the information of the extremal values and interconnecting them with the interpolating curves, thereby to reproduce the musical waveshape approximately.

4. An electronic musical instrument having waveshape memory parts for storing musical waveshapes on a time shared basis corresponding to a plurality of channels of key codes provided by turning ON and OFF key switches, characterized in that the waveshape memory part of each channel is a variable-stage shift register having its number of stages set in proportion to a note frequency and storing one period of the waveshape and in that a read clock for the waveshape memory part is constant regardless of the note frequency, wherein there is provided a keyboard circuit or a tone selector circuit using a shift register having connected in parallel thereto key switches or tone selection switches, wherein the ON-OFF states of all the switches are simultaneously written in the shift register by sampling pulses, and wherein signals written in the shift register are serially outputted from the shift register.

5. An electronic musical instrument having waveshape memory parts for storing musical waveshapes on a time shared basis corresponding to a plurality of channels of key codes provided by turning ON and OFF of key switches, characterized in that the waveshape memory part of each channel is a variable-stage shift register having its number of stages set in proportion to a note frequency and storing one period of the waveshape and in that a read clock for the waveshape memory part is constant regardless of the note frequency, which achieves digital processing in a keyboard circuit and wherein an asynchronous interface circuit formed with a memory is provided between an extraction part for extracting ON-OFF signals of the key switches or tone selection switches and a control part for achieving channel assignment with the ON-OFF signals, and wherein the processing timing of the control part is independent of that of the extraction part.

6. An electronic musical instrument of the type digitally controlling an envelope, comprising an envelope control circuit in which an envelope coefficient constituting an assigned value indicating the state of the envelope is stored in each stage of a shift register, a circulating loop is formed with the shift register and an adder and the envelope coefficient from the shift register is applied to a comparator to control the output from the adder with the output level signal or an external control signal to thereby change the envelope coefficient to provide an indication of transition from one state to another, whereby the envelope coefficient of each channel is set on a time shared basis.

7. An electronic musical instrument according to claim 6, which further includes an envelope calculation circuit for obtainng an envelope waveshape by calculation based on the envelope coefficient.

8. An electronic musical instrument according to claim 7, wherein, letting the envelope coefficient be represented by x, the envelope calculation circuit is composed of a calculator performing a calculation using an approximate equation $\log x \approx x - x^2/2$, and its complementer.

* * * * *